United States Patent [19]

Vandervaart

[11] Patent Number: 4,458,665

[45] Date of Patent: Jul. 10, 1984

[54] HEAT EXCHANGER WITH BAFFLE PLATES

[75] Inventor: Gerry Vandervaart, Niagara Falls, Canada

[73] Assignee: Kool-Fire Limited, Niagara Falls, Canada

[21] Appl. No.: 259,918

[22] Filed: May 4, 1981

[51] Int. Cl.[3] ..... F25B 9/00

[52] U.S. Cl. ..... 126/101; 126/99 D; 122/44 A; 122/155 A; 165/29; 165/126

[58] Field of Search ..... 62/238.6, 304, 305, 62/506, 507, 508; 122/44 A, 155 A; 126/99 D, 101, 116 R; 165/122, 126, 29

[56] References Cited

U.S. PATENT DOCUMENTS

| | | | |
|---|---|---|---|
| 2,529,977 | 11/1950 | Thomas | 126/101 |
| 2,780,445 | 2/1957 | Rimbach | 165/124 |
| 2,827,893 | 3/1958 | Ribaudo et al. | 126/101 |
| 3,157,227 | 11/1964 | Palmer | 165/29 |
| 3,294,082 | 12/1966 | Norris | 126/116 R |
| 3,627,031 | 12/1971 | Ware | 165/29 |
| 3,716,097 | 2/1973 | Kelp et al. | 165/39 |
| 3,831,670 | 8/1974 | Mullings | 165/124 |
| 4,210,102 | 7/1980 | Dosmann | 126/101 |
| 4,319,557 | 3/1982 | Sietmann et al. | 126/110 R |

FOREIGN PATENT DOCUMENTS

| | | | |
|---|---|---|---|
| 2733900 | 2/1979 | Fed. Rep. of Germany | 165/29 |
| 437214 | 4/1912 | France | 122/155 A |

*Primary Examiner*—Allen M. Ostrager
*Attorney, Agent, or Firm*—Diller, Ramik & Wight

[57] ABSTRACT

This disclosure is directed to a heat exchanger which includes a coil through which a heat exchange medium, such as Freon, is circulated between an inlet and an outlet, the coil defining an interior chamber having a lower chamber portion, means for generating a flame, such as a natural gas burner at a lower end portion of the coil whereby heat is introduced into the interior chamber and rises upwardly therein such that the same might be absorbed by the heat exchange medium for subsequent utilization, a pair of baffle plates disposed within the interior chamber in generally upwardly opening diverging relationship for directing heat generally outwardly toward the coil for substantially total absorption thereof by the heat exchanger medium, and a fan for drawing a limited amount of air from the exterior of the coil to create a negative pressure for assuring air flow from the interior chamber to the exterior thereof through the coil.

13 Claims, 4 Drawing Figures

FIG. 3
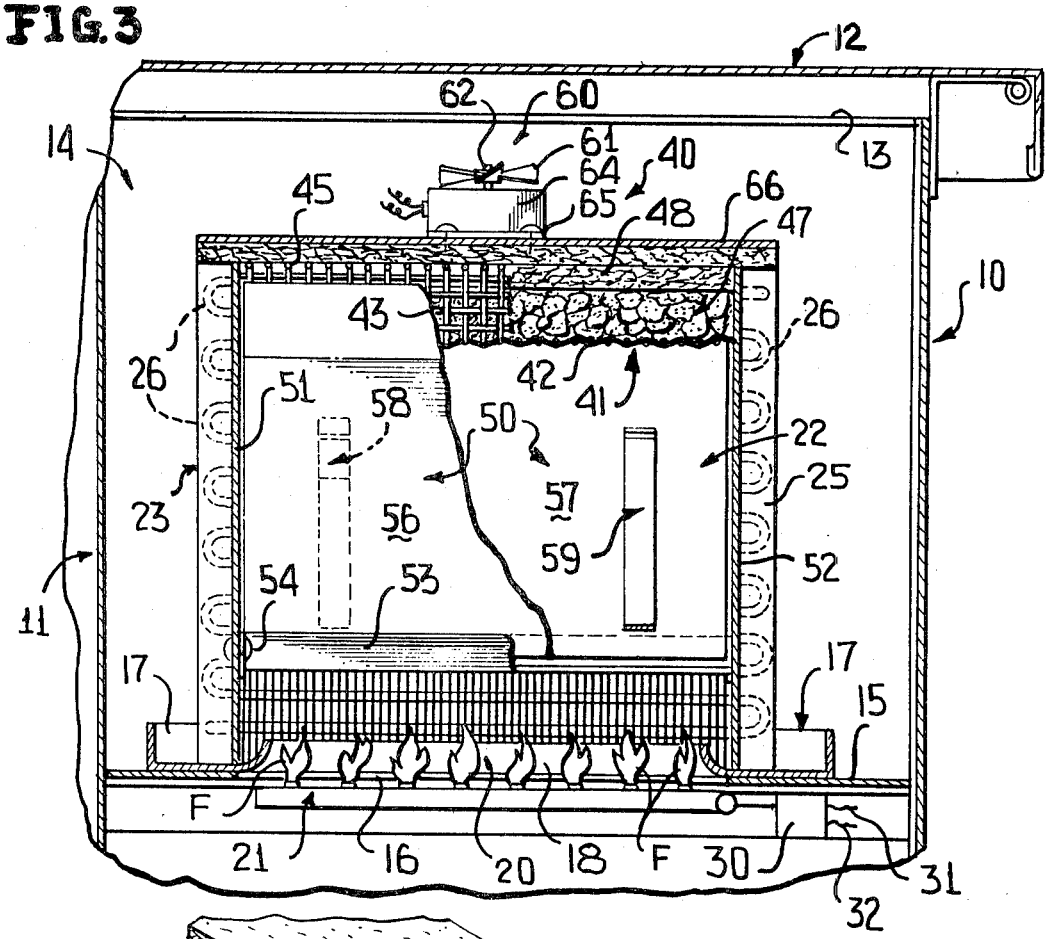
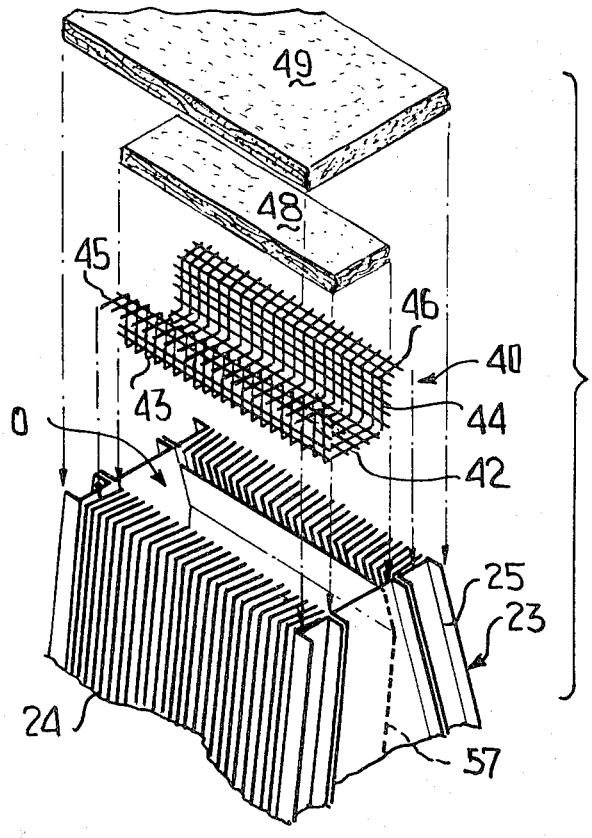
FIG. 4

HEAT EXCHANGER WITH BAFFLE PLATES

The present invention is directed to a novel heat exchanger which forms an improvement of the "Heat-Augmented Heat Exchanger" disclosed in applicant's corresponding U.S. patent application Ser. Nos. 54,647 and 87,154 filed on July 3, 1979 and Oct. 22, 1979, respectively, and now respective U.S. Pat. Nos. 4,311,191 and 4,311,192 issued respectively on Jan. 19, 1982 and Jan. 19, 1982.

In the latter-noted applications, a heat exchanger is disclosed in which an outdoor coil is subjected to heat other than ambient air by, for example, a gas burner. This heat is absorbed by the heat exchange medium (Freon) passing through the coils of the heat exchanger, which is an "A-coil", and heat thus absorbed generally drives the heat exchange medium from its liquid to its vapor phase with the latter being utilized for indoor heating purposes. While the latter system is extremely efficient, it has been rendered more so by the present invention.

In keeping with the present invention, an upper end portion of the "A-coil" is closed by heat insulating material and, therefore, virtually all of the heat which rises within an interior chamber of the "A-coil" flows upwardly and outwardly through the individual coils of the "A-coil", and virtually none of the heat escapes unused or unabsorbed through the top of the "A-coil". In the latter manner, virtually all of the heat generated by the gas burners or the equivalents thereof (resistance heaters, steam generators, etc.) is totally absorbed, thus increasing the efficiency of the overall heat exchanger.

In further accordance with this invention, means in the form of a small fan is provided in an area above the "A-coil", and control means are provided for initiating the rotation of the fan generally simultaneously with the ignition of the gas burner such that a slight draft or draw is effected in the interior chamber of the "A-coil" to prevent oxygen depletion internally of the "A-coil" from in effect stifling the flames of the gas heater and alternatively to preclude down-drafting of oxygen-depleted air (carbon dioxide) which would otherwise tend to extinguish the flames of the gas burner. Stated another way, the interior chamber of the "A-coil" is at atmospheric temperature and pressure and, therefore, there is sufficient air/oxygen for initial combustion. However, under certain conditions, once combustion occurs, the air/oxygen within the interior chamber of the "A-coil" can become quickly depleted if, for example, the ambient air is relatively cold and the natural convection currents of the hot flames can not force the colder air rapidly outwardly from the interior of the "A-coil". Under such conditions, combustion gasses which are depleted of oxygen will progressively and rapidly collect in the interior of the "A-coil" and thus quickly extinguish the flames of the gas burner shortly after being begun or ignited. Thus, by starting the fan at about the time the burner is ignited, a negative pressure is created within the interior chamber of the "A-coil" thereby drawing the air and/or gasses of combustion from the interior chamber of the "A-coil" through the coils thereof and outwardly of the "A-coil" to assure continued burning of the gas flame.

Still another object of this invention is to provide within the "A-coil" and between the gas burner and the upper insulating means or cover a generally upwardly opening V-shaped baffle which is designed to direct the flames or heat from the burners in an outward direction toward the coils of the "A-coil" again assuring that the heat is absorbed in as efficient and as maximized a manner as is possible.

In further accordance with this invention, the baffle just described is preferably formed of a pair of plates seated within a trough for support spanning a lower portion of the "A-coil" within the interior thereof, and a suirable spring or springs are inserted within and between the baffle plates to hold the same in position within the interior chamber of the "A-coil".

With the above and other objects in view that will hereinafter appear, the nature of the invention will be more clearly understood by reference to the following detailed description, the appended claims and the several views illustrated in the accompanying drawings.

IN THE DRAWINGS

FIG. 3 is a sectional view taken generally along line 3—3 of FIG. 2, and illustrates details of the insulating means, the baffle plates and the springs associated therewith.

FIG. 4 is an exploded perspective view of an upper portion of the "A-coil", a support for particulate insulating material and two sheets of insulating material.

Figure 1:
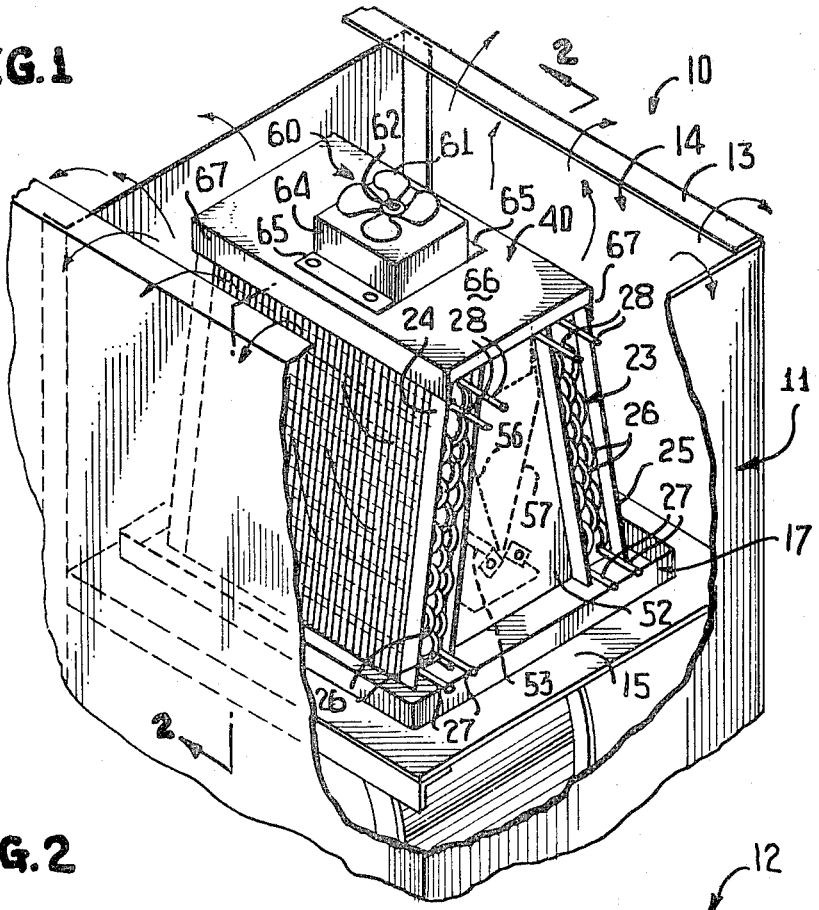
FIG. 1 is a fragmentary perspective view of a novel heat exchanger constructed in accordance with this invention, and illustrates a fan atop a housing for insulating means associated with an "A-coil".

Reference is now made to the drawings in which a novel heat exchanger constructed in accordance with this invention is generally designated by the reference numeral 10 and includes as part thereof a conventional housing 11 closed by a cover 12, though the latter is spaced somewhat above an uppermost peripheral edge portion 13 of the housing 11 to permit circulation between an interior 14 of the housing 11 and the exterior thereof. The interior 14 of the housing 11 includes a generally horizontal partition or support 15 having a generally rectangular opening 16 with the partition 15 supporting a generally shallow condensate collecting reservoir or pan 17 having an upwardly directed, generally rectangular wall 18 defining a generally rectangular opening 20. Supported in a conventional manner contiguous the opening 20 is a natural gas burner 21 which defines means for introducing heat into an interior chamber 22 of coil means 23 which is an "A-coil" having a pair of generally upwardly converging legs 24, 25, each of which includes conventional coils 26 through which a heat exchange medium, such as Freon, is circulated in a conventional manner between one or more inlets which are simply schematically illustrated by headed arrows 27 and one or more outlets which are similarly schematically illustrated by headed arrows 28. Natural gas is introduced into the burner 21 through a conventional control mechanism 30 (FIG. 3) which includes a valve for the gas and an electrical igniter, both of which are controlled from a suitable control box (not shown) over leads 31, 32 such that upon the energization of the control means 30, the valve is open, gas enters the burner 21 and is ignited by the electric ignition device to create the flames F resulting in upwardly rising heat, as is indicated by the unnumbered headed arrows in FIGS. 1 and 2. The heat is, of course, absorbed by the heat exchange medium travelling generally upwardly in the coils 26, thus changing the phase of the normally liquid refrigerant or heat exchange medium as it enters the inlets 27 to its vapor phase as it exits the coils 26 through the outlets 28 for subsequent utilization to heat a house, office or similar building by simply connecting the outlets 28 and the inlets 27 in a conventional series connection to a compressor (not shown), an expansion valve (also not shown), and an indoor coil (not shown) in the usual and well known "heat pump" system. As thus far described, the heat exchanger 10 corresponds generally to that set forth in the latter-noted applications and for further details in regard to the specifics thereof, reference may be had to the latter applications.

In order to realize optimum output from the coil means 23, it is necessary to absorb as much as the heat by the heat exchange medium and the coils 26 as is generated by the flames F and in order to do so, the present invention includes first means generally designated by the reference numeral 40 for closing an upper end portion (unnumbered) of the interior chamber 22 of the "A-coil" 23 to prevent heat generated by the flames F from flowing therethrough, whereby essentially all of the heat introduced into the interior chamber 22 is absorbed during its passage therethrough and to the exterior of the "A-coil" 23 through the spaced coils or coil portions 26 in the manner indicated by the unnumbered headed arrows. Furthermore, the present invention also includes further means designated by the reference numeral 50 for directing the heat during its upward passage through the interior chamber 22 in generally an upward and outward direction whereby the heat passes along and through the spaced coil or coil portions 26 and, thus, is readily absorbed by the heat exchange medium therein.

Associated with both of the means 40 and 50 are also means 60 in the form of a fan for creating negative pressure within the interior chamber 22 of the "A-coil" 23 or, stated otherwise, for creating a slight draft or upward draw such that substantially simultaneously with the ignition of the gas to create the flames F by the control means 30 over the leads 31, 32, the fan 60 is likewise energized over the same leads 31, 32. This creation of the negative pressure within the interior chamber 22 assures that combustion gasses, such as carbon dioxide, do not accumulate within the interior chamber 22 which might otherwise extinguish the flames F shortly after the same have been begun.

The specific construction of the means 40 includes a generally U-shaped wire or mesh basket 41 (FIG. 4) which includes a bottom wall 42, a pair of side walls 43, 44, and respective oppositely outwardly directed supporting flanges 45, 46. The screen 41 fits snugly within an upper opening O (FIG. 4) of the "A-coil" 23 and is suspended therein by the flanges 45, 46 resting atop the "A-coil" 23, as is most readily apparent from FIG. 2 of the drawings. The interior of the screen 41 is filled with loose or pulverulent heat insulating material or insulation which is generally designated by the reference numeral 47. A sheet 48 of insulating material is then placed atop the pulverulent insulating material 47, again as is most readily apparent from FIGS. 2 and 4 of the drawings. Finally, a relatively larger sheet 49 of the heat insulating material 49 seats atop the sheet of insulating material 48 and also spans the overall upper peripheral outline of the "A-coil" 23. By virtue of the heat insulating material 47, 48 and 49 of the closing means 40, all of the heat generated within the interior chamber 22 of the "A-coil" must necessarily exit the chamber 22 by passing through the coils 26 of the legs 24 and 25 thereby maximizing the absorption of the heat by the heat exchange medium within the coils 26.

Figure 2:
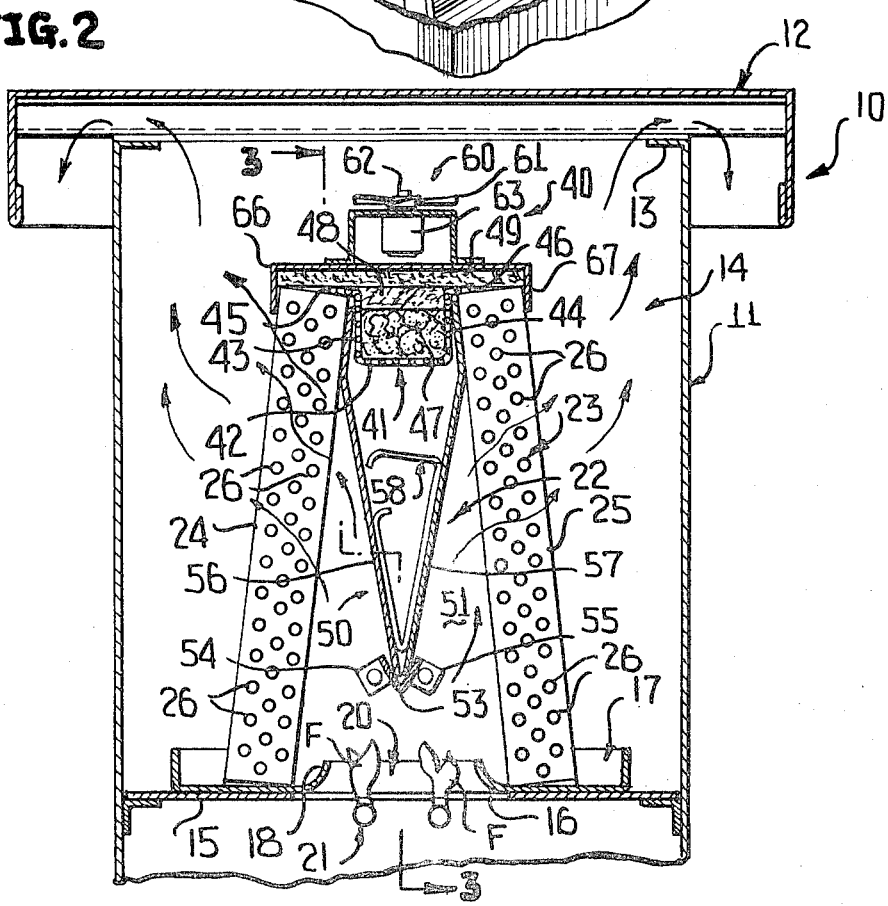
FIG. 2 is a cross-sectional view taken generally along line 2—2 of FIG. 1, and illustrates a pair of baffle plates within an interior chamber of the "A-coil" and a gas burner therebeneath.

Axially opposite ends of the "A-coil" 23 are closed by end plates 51, 52 and spanning the distance therebetween and connected thereto is a generally upwardly opening V-shaped bar 53 having legs 54, 55 at each end. The legs 54, 55 are suitably secured to the side plates 51, 52 in the manner most readily apparent from FIGS. 2 and 3 of the drawings. The means 50 include a pair of generally rectangular baffle plates 56, 57 each having lower terminal end portions (unnumbered) received within and supported upon the V-shaped bar 53 (FIGS. 2 and 3). Upper end portions (unnumbered) of the baffle plates 56, 57 are bent at an angle to correspond to the inner surfaces of the legs 24, 25 of the "A-coil" 23. A pair of metallic springs 58, 59 of a generally V-shaped configuration are inserted in a downward direction between the plates 56, 57 and the natural resiliency of the springs 58, 59 urge the plates 56, 57 outwardly such that the upper end portions of the baffle plates 56, 57 are in intimate engagement with the inner surfaces of the legs 24, 25 of the "A-coil" 23. Thus, as the heat rises along the paths indicated by the unnumbered headed arrows in FIG. 2, the baffle plates 56, 57 direct the heat generally upwardly and outwardly such that the same moves through the coils 26 and is, of course, totally absorbed by the heat exchange medium in the coils 26. Furthermore, the baffle plates 56, 57 are made of metal, and they, themselves, become heated by the heat from the flames F and, of course, also radiate this heat outwardly toward the legs 24, 25 of the "A-coil" 23. Furthermore, the upper end portions (unnumbered) of the baffle plates 56, 57 transfer the heat through conduction since they contact the inner surfaces of the legs 24, 25. Thus, the baffle plates 56, 57 are effective to not only direct the heat rising from the flames F toward the coils 26, but also direct heat therethrough by both convection and conduction currents.

The draft creating means or negative air pressure creating means 60 simply includes, as was heretofore noted, a fan whose blade 61 is fixed to a shaft 62 in a conventional manner and the same is driven by an electric motor 63 connected to the control circuit (not shown) of the overall heat exchanger 10 such that the same leads 31,32 also energize the burner 21. The means 60 is supported in a conventional manner by a metallic housing 64 having flanges 65 which are bolted or otherwise connected to a shallow metallic inverted U-shaped cover 66 which houses the sheet 49 of heat insulating material. Flanges 67 of the cover 66 also partially overlap exterior surfaces of the upper end portions of the legs 24, 25 of the "A-coil" 23. Thus, as the burner 21 is ignited, the fan blade 61 rotates and causes an upward circulation of air which, in effect, draws the heat upwardly along the same paths indicated by the unnumbered headed arrows in FIGS. 1 and 2, thus assuring that the flames F will not be abruptly extinguished due to oxygen depletion within the interior 22 of the "A-coil" 23.

Although only a preferred embodiment of the invention has been specifically illustrated and described herein, it is to be understood that minor variations may be made in the apparatus without departing from the spirit and scope of the invention, as defined in the appended claims.

I claim:

1. A heat exchanger comprising "A-coil" means for conducting therethrough a heat exchange medium, said "A-coil" means including a pair of upwardly converging coils defining an interior chamber into and upwardly through which air is adapted to flow, said pair of coils each including relatively spaced coil portions between which air passes from said interior chamber to the exterior thereof, said "A-coil" means having a generally open lower end portion in fluid communication with said interior chamber, means for generating an open flame immediately at said open lower end portion and introducing the open flame into said interior chamber through said open lower end portion whereby heat from the open flame is directly absorbed by the heat exchange medium during the passage of the heat into the interior chamber and through the spaced coil portions, and means within said interior chamber between said upwardly converging coils for directing the open flame during its passage through said interior chamber upwardly and oppositely outwardly through said coil portions of each pair of coils whereby the heat passes through the spaced coil portions and thus is readily absorbed by the heat exchange medium.

2. A heat exchanger comprising coil means for conducting therethrough a heat exchange medium, said coil means defining an interior chamber into and upwardly through which air is adapted to flow, said coil means including relatively spaced coil portions between which air passes from said interior chamber to the exterior thereof, said coil means having a generally open lower end portion in fluid communication with said interior chamber, means for generating an open flame immediately at said open lower end portion and introducing the open flame into said interior chamber through said open lower end portion whereby heat from the open flame is directly absorbed by the heat exchange medium during the passage of the heat into the interior chamber and through the spaced coil portions, means for directing the open flame during its passage through said interior chamber upwardly and outwardly whereby the heat passes through the spaced coil portions and thus is readily absorbed by the heat exchange medium, said coil means being an "A-coil" having a pair of upwardly coverging coil portions, said open flame directing means being defined by generally upwardly diverging baffle plates between said upwardly converging coil portions, and means for urging said baffle plates away from each other and toward respective ones of said pair of upwardly converging coil portions.

3. A heat exchanger comprising coil means for conducting therethrough a heat exchange medium, said coil means defining an interior chamber into and upwardly through which air is adapted to flow, said coil means including relatively spaced coil portions between which air passes from said interior chamber to the exterior thereof, said coil means having a generally open lower end portion in fluid communication with said interior chamber, means for introducing heat into said interior chamber through said open lower end portion whereby the heat is absorbed by the heat exchange medium during the passage of the heat into the interior chamber and through the spaced coil portions, means for directing the heat during its passage through said interior chamber upwardly and outwardly whereby the heat passes through the spaced coil portions and thus is readily absorbed by the heat exchange medium, said coil means being an "A-coil" having a pair of upwardly converging coil portions, said heat directing means being defined by generally upwardly diverging baffle plates between said upwardly converging coil portions, and means beneath and generally spanning said coil means for supporting lower edges of said baffle plates.

4. The heat exchanger as defined in claim 3 wherein said supporting means is in the form of a generally upwardly opening V-shaped bar.

5. The heat exchanger as defined in claim 4 including spring means between said baffle plates for urging said baffle plates away from each other and toward respective ones of said pair of upwardly converging coil portions.

6. A heat exchanger comprising coil means for conducting therethrough a heat exchange medium, said coil means defining an interior chamber into and upwardly through which air is adapted to flow, said coil means including relatively spaced coil portions between which air passes from said interior chamber to the exterior thereof, said coil means having a generally open lower end portion in fluid communication with said interior chamber, means for generating an open flame immediately at said open lower end portion and introducing the open flame into said interior chamber through said open lower end portion whereby heat from the open flame is directly absorbed by the heat exchange medium during the passage of the heat into the interior chamber and through the spaced coil portions, means for directing the open flame during its passage through said interior chamber upwardly and outwardly whereby the heat passes through the spaced coil portions and thus is readily absorbed by the heat exchange medium, and fan means for drawing a limited amount of air from the exterior of said coil means and for creating a negative pressure for assuring air flow from said interior chamber to the exterior thereof through said spaced coil portions.

7. A heat exchanger comprising coil means for conducting therethrough a heat exchange medium, said coil means defining an interior chamber into and upwardly through which air is adapted to flow, said coil means including relatively spaced coil portions between which air passes from said interior chamber to the exterior thereof, said coil means having a generally open lower end portion in fluid communication with said interior chamber, means for generating an open flame immediately at said open lower end portion and introducing the open flame into said interior chamber through said open lower end portion whereby heat from the open flame is directly absorbed by the heat exchange medium during the passage of the heat into the interior chamber and through the spaced coil portions, means for directing the open flame during its passage through said interior chamber upwardly and outwardly whereby the heat passes through the spaced coil portions and thus is readily absorbed by the heat exchange medium, said coil means being an "A-coil" having a pair of upwardly converging coil portions, said open flame directing means being defined by generally upwardly diverging baffle plates between said upwardly converging coil portions, and lower edges of said baffle plates being disposed generally centrally of said "A-coil" and extend generally the length of said converging coil portions thereby dividing said interior chamber into a pair of generally upwardly converging interior chambers.

8. The heat exchanger as defined in claim 7 wherein said open flame generating means is disposed immediately contiguous said baffle plates lower edges.

9. The heat exchanger as defined in claim 7 including means for urging said baffle plates away from each other and toward respective ones of said pair of upwardly converging coil portions.

10. The heat exchanger as defined in claim 7 wherein said open flame generating means includes an open flame immediately contiguous said baffle plate lower edges.

11. The heat exchanger as defined in claim 7 including fan means for drawing a limited amount of air from the exterior of said coil means thereby creating a negative pressure for assuring air flow from said interior chamber to the exterior thereof through said spaced coil portions.

12. The heat exchanger as defined in claim 11 wherein said open flame generating means includes an open flame immediately contiguous said baffle plate lower edges.

13. A heat exchanger comprising coil means for conducting therethrough a heat exchange medium, said coil means defining an interior chamber into and upwardly through which air is adapted to flow, said coil means including relatively spaced coil portions between which air passes from said interior chamber to the exterior thereof, said coil means having a generally open lower end portion in fluid communication with said interior chamber and a generally closed upper end portion, means for generating an open flame immediately at said open lower end portion and introducing the open flame into said interior chamber through said lower end portion whereby the heat from the open flame is absorbed by the heat exchange medium during the passage of the heat into the interior chamber and through the spaced coil portions, fan means atop said generally closed upper end portion for drawing a limited amount of air from the exterior of said coil means thereby creating a negative pressure within said interior chamber for assuring air flow from said interior chamber to the exterior thereof through said spaced coil portions, and means for directing the open flame during its passage through said interior chamber upwardly and outwardly whereby the heat passes through the spaced coil portions and, thus, is readily absorbed by the heat exchange medium.

* * * * *